US007511292B2

(12) United States Patent
Baudro

(10) Patent No.: US 7,511,292 B2
(45) Date of Patent: Mar. 31, 2009

(54) RADIATION PROTECTION SHIELD

(75) Inventor: Thomas Baudro, Gales Ferry, CT (US)

(73) Assignee: NFS-Radiation Protection Systems, Inc.

( * ) Notice: Subject to any disclaimer, the term of this patent is extended or adjusted under 35 U.S.C. 154(b) by 811 days.

(21) Appl. No.: 10/999,719

(22) Filed: Nov. 30, 2004

(65) Prior Publication Data

US 2009/0020713 A1 Jan. 22, 2009

Related U.S. Application Data

(60) Provisional application No. 60/622,741, filed on Oct. 28, 2004.

(51) Int. Cl.
*G21F 7/00* (2006.01)

(52) U.S. Cl. ..... 250/515.1; 250/505.1; 250/517.1; 250/518.1

(58) Field of Classification Search ..... 250/505.1, 250/515.1, 517.1, 518.1
See application file for complete search history.

(56) References Cited

U.S. PATENT DOCUMENTS 4,090,083 A * 5/1978 Wyvill ..... 250/390.01
4,530,813 A * 7/1985 Jacobson ..... 376/287
4,608,495 A * 8/1986 Jacobson ..... 250/517.1
4,833,335 A * 5/1989 McGinley et al. ..... 250/518.1
7,060,998 B2 * 6/2006 Forrest et al. ..... 250/506.1

FOREIGN PATENT DOCUMENTS

FR 2630856 A1 * 11/1989
JP 09230091 A * 9/1997

* cited by examiner

*Primary Examiner*—Jack I Berman
*Assistant Examiner*—Michael Maskell

(57) ABSTRACT

The present invention in one of its preferred structural embodiments comprises a plurality of generally rectangular radiation attenuating panels having rollers mounted on the bottom of each panel and rollable in a lower track mounted on a base such as the concrete floor of a building for movement of each panel along the lower track to a designated position to isolate workers in a particular area from a source of harmful radiation, wherein an upper track is mounted on a rigid structure adjacent upper portions of the panels for laterally engaging in a guiding manner upper guide elements on the upper portions wherein the upper track has substantially the same longitudinal configuration (tracking axis) as the lower track.

10 Claims, 5 Drawing Sheets

RADIATION PROTECTION SHIELD

This application claims priority under 35 U.S.C. 119(e)(1) based on Applicants Provisional U.S. Patent Application Ser. No. 60/622,741 filed Oct. 28, 2004 and titled "RADIATION PROTECTION SHIELD".

BACKGROUND OF THE INVENTION

Field

This invention concerns a radiation protective shield structure which can be made transportable and which can be set up at various work sites within or without a building at which sites workers could otherwise be exposed to harmful radiation during maintenance or inspection of equipment or installations or other operations.

The available work time per individual worker in a high radiation area is a function of two factors, the actual radiation level measured in the work area and the amount of radiation dose that the worker can safely be exposed to. The time available for an individual to be in the radiation area is called the "stay time". When the work to be accomplished requires a period of time greater than the "stay time", an additional worker must be added. Where the radiation level is very high, the "stay time" may be reduced to minutes and many workers would be required. Before an individual can start the work assigned, a lengthy Rad Worker training program must be completed and also generally, a job specific training program. The training may take several days to make the individual available for a few minutes actual work.

A principal object therefore of this invention is to provide a shield, preferably one which is transportable and readily adapted for overall size expansion, between the work area and a high radiation source of e.g., alpha, beta, gamma, mention, or the like. The lower radiation levels, resulting from the use of the shield, will allow a few individuals to accomplish the work that would have required a large number of workers without the shield. After work and/or inspections are complete, the shield can be partially or completely removed, or moved to another work site.

SUMMARY OF THE INVENTION

The present invention in one of its preferred structural embodiments comprises a plurality of generally rectangular (includes square) panels each of which is of a designed thickness having an inner lead or other radiation attenuating core encased (canned) in a steel (usually stainless) shield and having a tracking axis, two or more rollers mounted on the bottom of each panel, a lower track mounted on a base such as the concrete floor of a building for rollably supporting said rollers for movement of each said panel along said lower track to a designated position, said lower track being longitudinally configured to allow said panels to be rolled to positions to isolate workers in a particular area from a source of harmful radiation, first guide rail means on said lower track for maintaining proper alignment of said rollers with said lower track, an upper track mounted on a rigid structure adjacent upper portions of said panels and having second guide rail means for laterally engaging in a guiding manner upper guide elements on said upper portions of said panels, said upper track having substantially the same longitudinal configuration (tracking axis) as said lower track.

BRIEF DESCRIPTION OF THE DRAWINGS

The invention will be understood further from the following description and drawings of preferred embodiments wherein the various structures are not necessarily to scale or in proportion to each other, and wherein.

DETAILED DESCRIPTION

Figure 1:
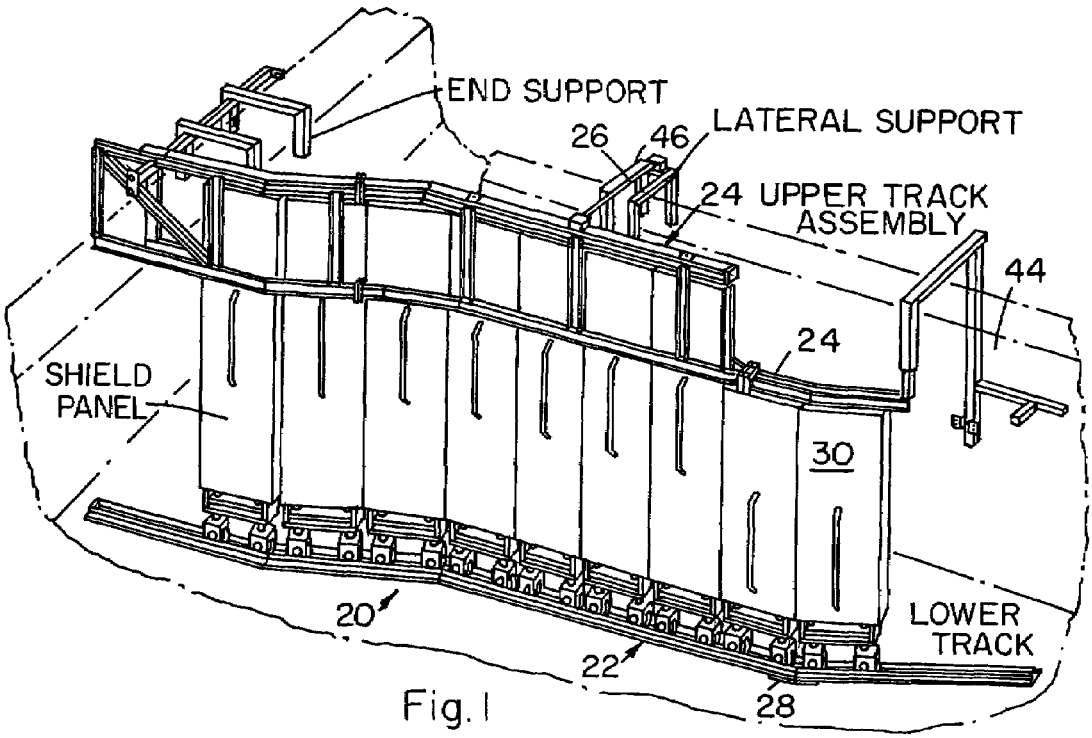
FIG. 1 is a perspective side view of complete present shield assembly of the type installed within a building and supported by brackets to permanent wall portions of the building structure.

Referring to the drawings and claims herein, the present shield assembly or structure generally designated 20 consists basically of a lower track 22, an upper track 24 and support means 26 therefor, a lower track support means 28 and the shield panels 30. All structural components of the shield assembly are steel or stainless steel, and, of course are sufficiently strong to rollably support panels which may weigh several thousands of pounds. Also, in the various figures equivalent structures may be numbered the same.

The lower track typically rests on the concrete floor 32 of a building and supports the shield structure and provides the path (tracking axis) which the shield panels will follow. The tracks 22 and 24 may be straight or have bends to guide the shield panels into the most advantageous position and 22 is provided with leveling means 34 if required.

Figure 5:
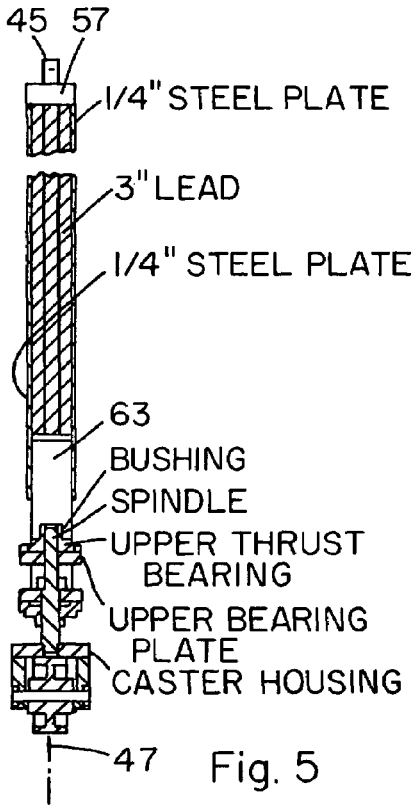
FIG. 5 is an enlarged lateral cross-section of the panel of FIG. 4 taken along line 5-5 in FIG. 4.
Figure 6:
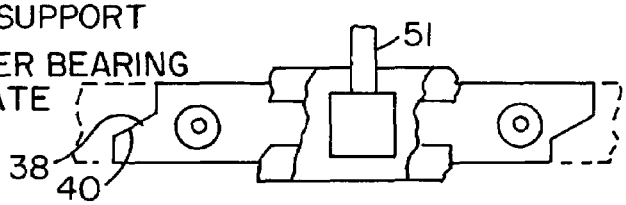
FIG. 6 is a top view of the panel of FIG. 4 taken along line 6-6 therein and showing portions of the upper track guide rail means and vertical axis mounted rollers (upper guide elements) on the panel.
Figure 12:
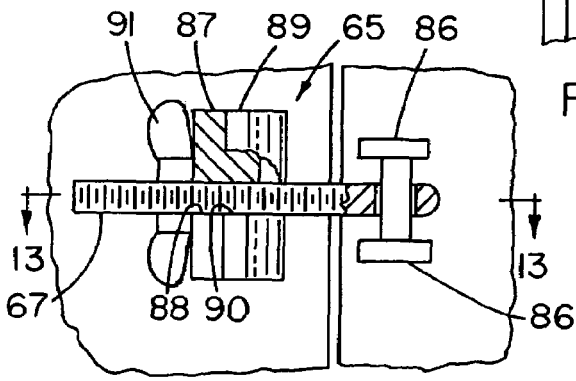
FIG. 12 is a side view of a panel of FIG. 9 showing details of a latching mechanism (dotted outlines in FIG. 9) useful for connecting the panels to each other once in position.
Figure 13:
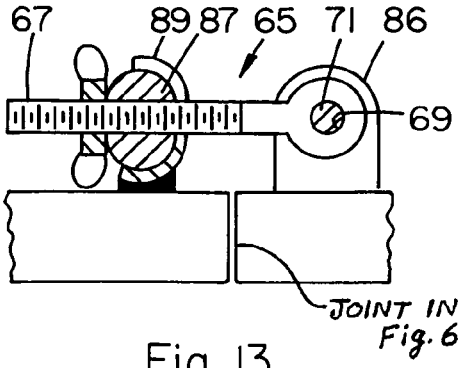
FIG. 13 is a view taken in the direction 13-13 in FIG. 12.
Figure 18:
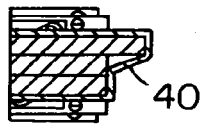
FIG. 18 is a cross-sectional view taken along line 18-18 in FIG. 4.
Figure 25:
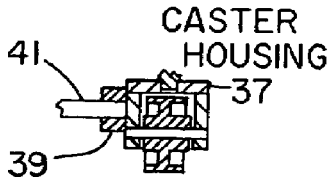
FIG. 25 shows a manual steering mechanism for the caster wheels as exemplified by a variation of the caster structure of FIG. 5.

The upper track 24 follows the path of the lower track and is supported overhead by support means 26 and guides the upper end of the shield panels and holds the panels substantially vertical. The upper track 24 may have more than one elevation, as shown in FIG. 1 to accommodate plant work area interferences requiring different height and or size panels. Each panel is fitted with two or more wheels or rollers 36 which can be of any configuration to fit the shape of the lower track, e.g., flat or crowned or grooved or the like and can be fixedly axially or of the caster type as shown, e.g., in FIG. 5. Provision to steer the caster type wheels may be incorporated as shown in FIG. 25. The wheels may also be powered, preferably by electric motors. The panels are of an appropriate shielding thickness, height, width and of proper shield material for the project at hand and is selected from material such as lead or other radiation attenuating material including concrete and steel. If the shield material is lead, an outer shell of steel, carbon steel or stainless steel preferably is provided to cover and seal any exposed lead. The panels lap over each other at their edges 38 and 40 as shown in FIGS. 6 and 18 to prevent radiation from streaming though the joint. The panels also have lifting provisions such as winch cable hook eyes 45 at the top. A latch mechanism as shown in FIGS. 12 and 13 can be provided to connect panels to adjacent panels in their operative positions and locations. The panels can be painted a light reflecting color to enhance the lighting in the work area.

The operational sequence of the invention is as follows:

The lower track is moved into place. It is leveled and secured to the floor if necessary. The upper track is then positioned, supported and secured directly above the lower track with their tracking axes aligned. Next the first shield panel is positioned vertically and placed on the lower track. It is advanced until the upper guide rollers are engaged in the upper track. The first panel is then advanced down the track to the required position. Additional shield panels are added as required. The entire track may be loaded with shield panels to develop a shield wall. One or more panels may be placed on the track in an assembly to shield a specific area. The panel assembly may be repositioned on the track as required.

Figure 2:
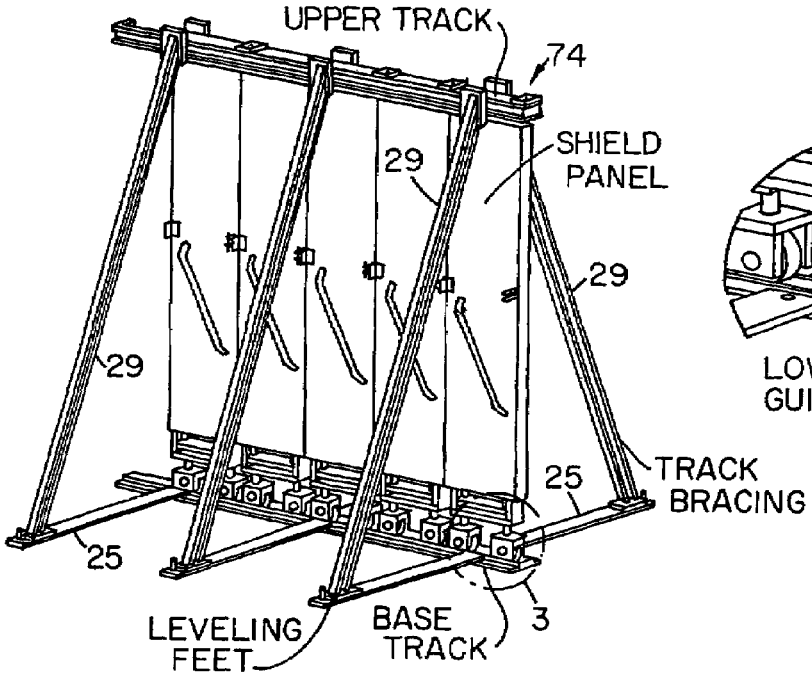
FIG. 2 is a perspective side view of a complete present shield assembly of the type which is self supporting and which is adapted for use within or outside a building.
Figure 19:
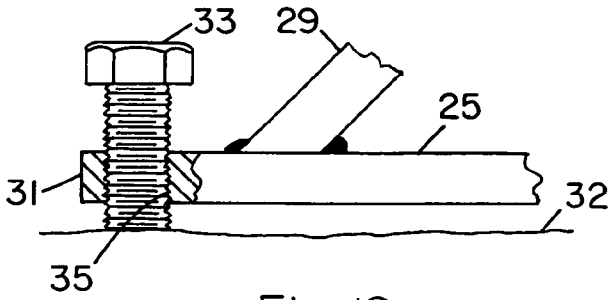
FIG. 19 is a partially cross-sectional view of a foot portion of a lateral stabilizer arm showing a leveling means for the arm.
Figure 20:
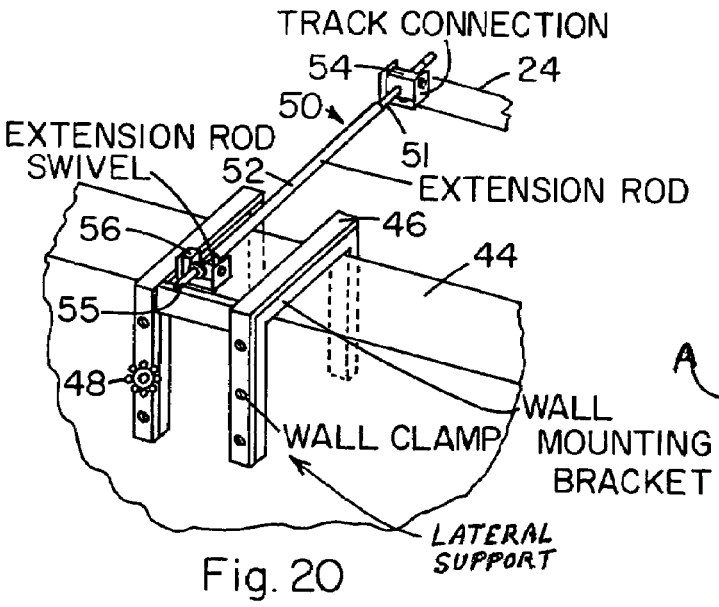
FIG. 20 is an enlarged perspective view of the upper track mounting bracket and vertical adjustment means.
Figure 21:
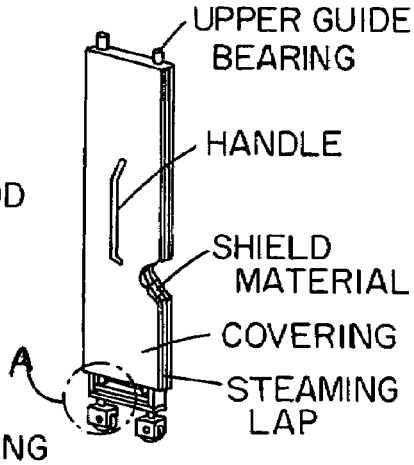
FIG. 21 is a partially cross-sectional perspective view of the panel of FIG. 1.
Figure 22:
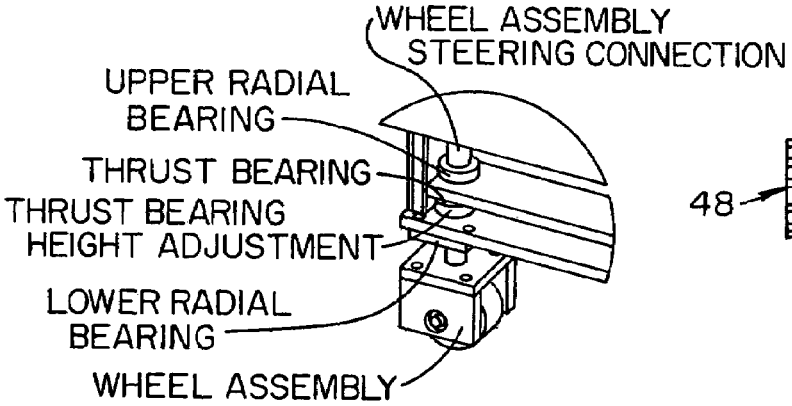
FIG. 22 is an enlarged view of the encircled structure in FIG. 21.

When the shield panels are no longer required, the panels may be removed, followed by the upper and lower track assemblies. In a further embodiment of this invention, the upper and lower track assemblies would be attached to each other and appropriately braced to make the movable shield free standing as shown in FIGS. 2 and 19. Hoisting equipment for lifting the shield panels and placing them on the track could include overhead travelling electric hoists, chain falls, electric winches, fork lift or other such equipment, and where feasible could be incorporated into the shield system itself or could be an independent unit or part of the track assembly.

Figure 8:
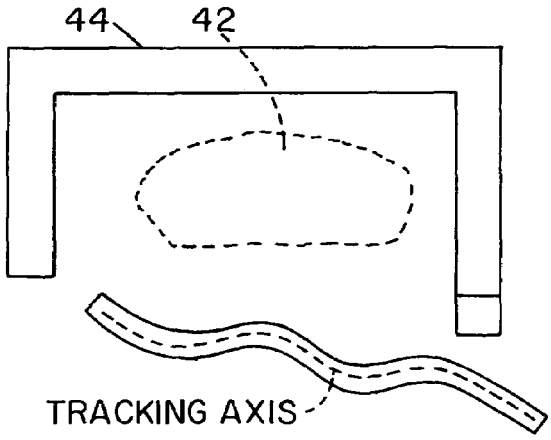
FIG. 8 is top perspective view of a present shield assembly affixed in a typical manner to internal wall portions of a building and surrounding a section of a radiation source.
Figure 9:
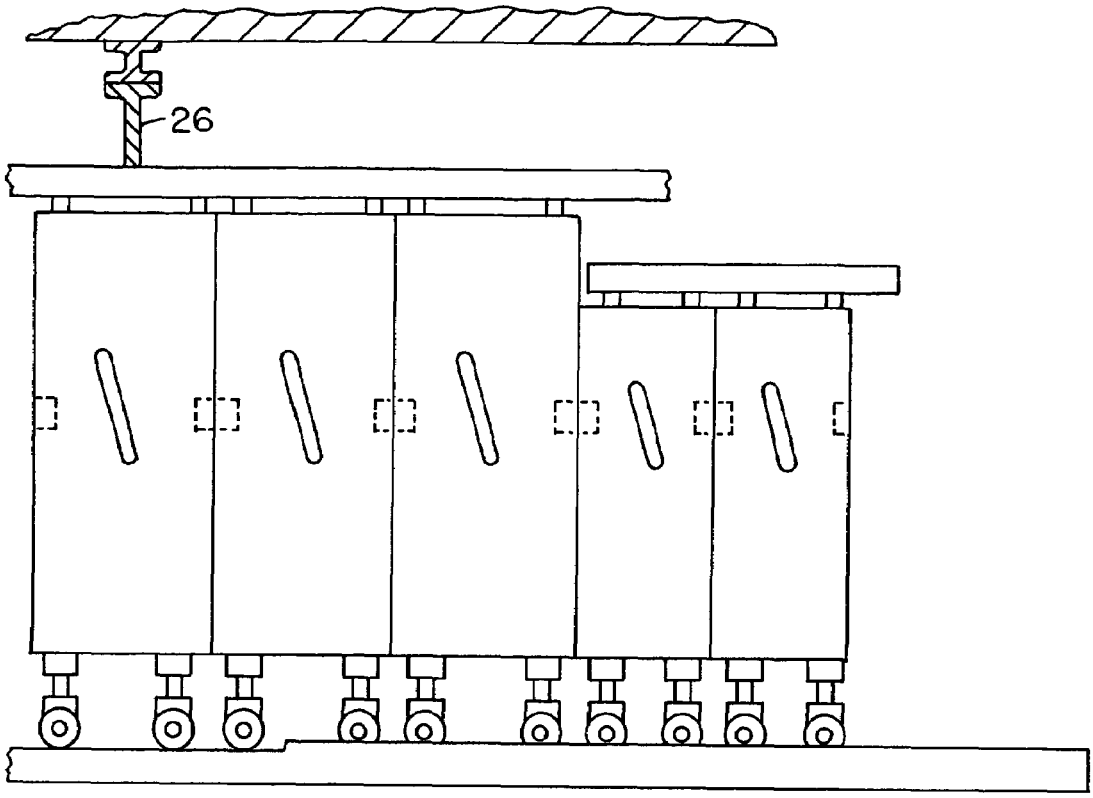
FIG. 9 is a side view of a series of positioned panels wherein the mounting support for the panels is provided by an inner I-beam structure of the building.

Referring further to the drawings, in particular FIGS. 1, 8, 16, 17, 20 and 23, many industrial installations wherein radioactive equipment or materials generally designated 42 in FIG. 8 are located are provided with radiation protective enclosures such as concrete walls 44 to protect workers who might be in the vicinity. Where it becomes necessary to practically completely protectively enclose dangerous areas, the present invention is a very practical way to accomplish it. In doing so, the lower track 22 is laid out in the configuration required by the radiation source 42 and by the locations which the workers must be in to perform their tasks. Such a layout, once it is determined as to shape and length, can be done by bending a straight track, 22 and 24 to the desired curvature or by providing the tracks in sections which can be connected together by mechanical means or by welding.

Figure 23:
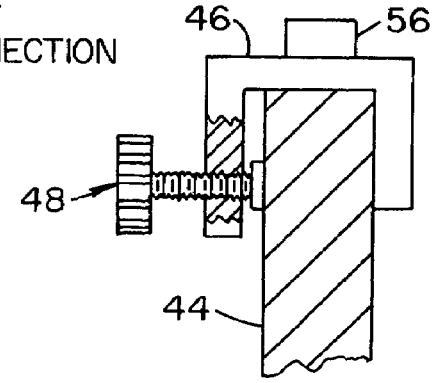
FIG. 23 is an enlarged partially cross-sectional view of a preferred type of wall clamping structure for the upper track wall mounting brackets.

Likewise the most appropriate size and shape of wall mounting brackets such as 46 can be provided for clamping to wall 44 by screw clamps 48 (FIG. 23). In this regard, once the lower track is set in position and leveled by leveling bolts 34 or the like, the upper track 24 is moved laterally to a vertical position over 22 by a screw mechanism (vertical adjustment means) generally designated 50 (FIG. 20) and comprising a rod section 51 threaded into a tube section 52, wherein 51 is connected to a vertical swivel joint 54 on the top of track 24, and 52 is connected to a vertical swivel joint 56 on the bracket 46. One of 51 or 52 is non-rotatable and longitudinally fixedd in its swivel joint and the other is rotatable but also longitudinally fixed in its swivel joint to afford the pushing or pulling of the upper track to a vertical position by relative rotation between 51 and 52.

Figure 16:
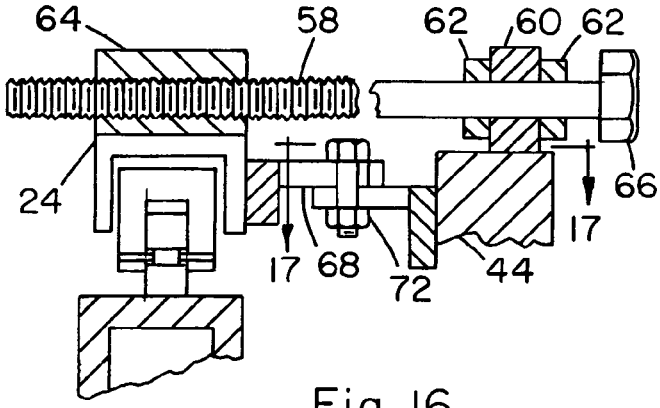
FIG. 16 is a partially cross-sectional view of a variation of the bracket structures of FIG. 1.
Figure 17:
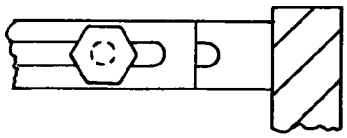
FIG. 17 is a top down view taken along line 17-17 in FIG. 16.

Referring to FIGS. 16 and 17, a variation of the vertical adjustment means is shown as comprising a threaded rod 58 rotatably mounted in a bushing 60 affixed to the top of wall 44 and longitudinally fixed therein by lock collars 62. The rod is threaded through a bushing 64 affixed to the top of track 24. Rotation of the bolt head 66 by e.g., a ratchet wrench, will push or pull the upper track to its proper verticality. A slotted arm 68 can be provided on the upper track and a complementary slotted arm 70 can be provided on wall 44 to firmly set the verticality of the upper track by tightening nut 72 on bolt 73.

Figure 3:
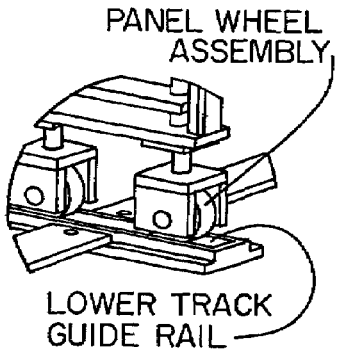
FIG. 3 is a perspective view of the roller and adjacent structure of FIG. 2 taken within the encircled area in FIG. 2.
Figure 4:
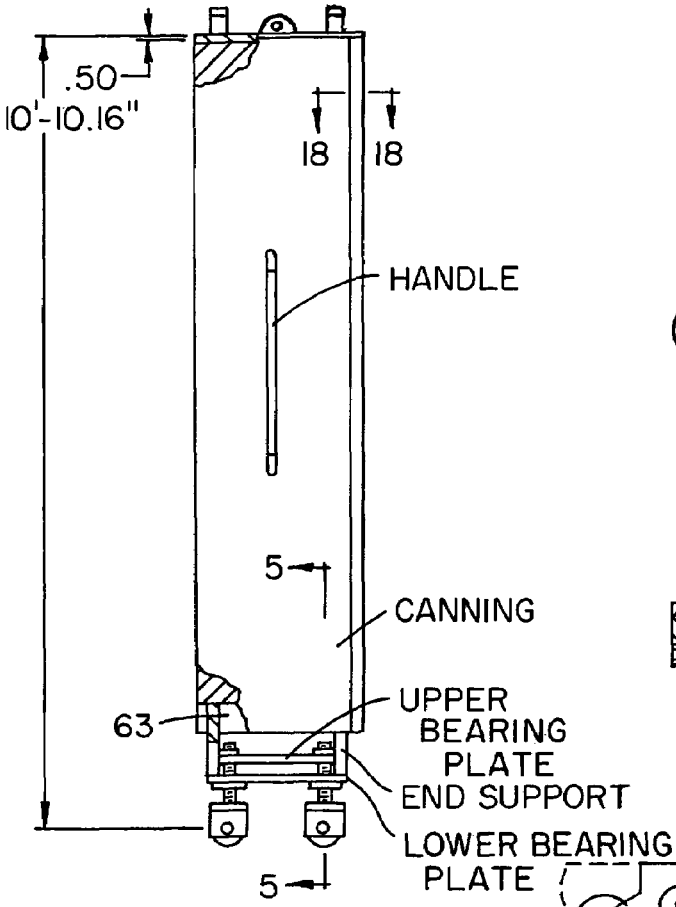
FIG. 4 is a side view of one useful type of panel with portions broken away for clarity.

Referring to FIGS. 2, 3 and 19, the stand along embodiment generally designated 74 comprises the same upper track, panels and lower track as in, e.g., FIG. 1, but does not require brackets or the like such as 46 for attaching the upper track to a structural portion of a building.

In this embodiment of the present shield each side of the track base 23 is affixed to stabilizer arms 25 which are welded to the base or are affixed thereto by screws 27 or the like whereby the arms can be disassembled from the base. Opposing pairs of bracing 29 are affixed to arms 25 and to the upper track by welding or screws or the like, again to be able to disassemble the shield for easy transport thereof. Each foot portion 31 of arms 25 is provided with a leveling means such as bolt 33 threaded through the foot and adapted to firmly engage the floor and rigidly stabilize the shield assembly.

Figure 14:
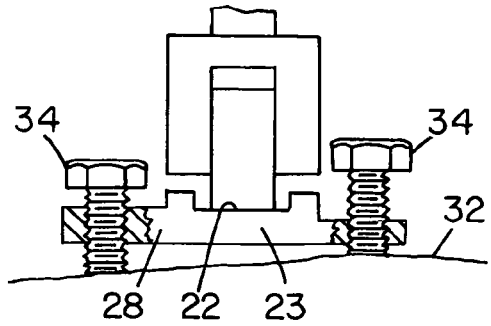
FIG. 14 is a lateral cross-sectional view of the lower track showing one embodiment of the track leveling means.
Figure 15:
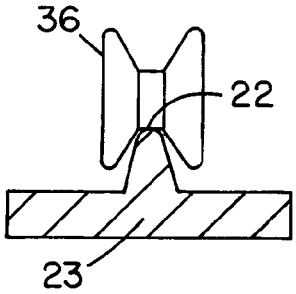
FIG. 15 is a lateral cross-sectional view of a variation of the lower track and complementary roller.

In the placement of shield 74 wherein the shield sections are assembled, a preferred procedure for making it ready for use is to first level the lower track laterally and longitudinally by means of the leveling bolts 34 (FIG. 14) or other leveling means such as to posture the panels in a vertical plane 47. The leveling bolts 33 on the arms 25 are then adjusted in their screw sockets 35 to firmly engage the floor 32 and thus stabilize the entire shield assembly.

Referring to FIG. 25, the caster housing 37 can be provided with a socket member 39 into which a steering rod 41 can be inserted and employed as a lever to rotate the caster housing and spindle 43 to steer the roller.

Figure 7:
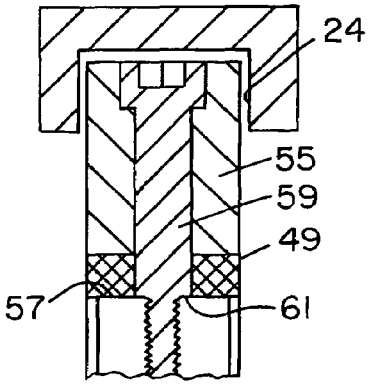
FIG. 7 is a partially cross-sectional view of the upper portion of a panel with upper guide elements (rollers) and portions of the upper track shown.

Referring to the variation of FIG. 7, the guide rollers 55 are affixed to the tops 57 of the panels by an Allen type screw 59 passing through a thrust bearing 49 and having a shoulder 61 bearing on top 57 of the panel.

Figure 24:
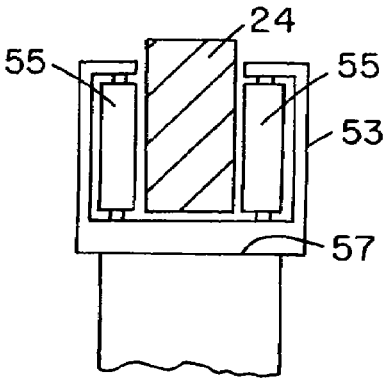
FIG. 24 is a lateral cross-sectional view of a variation of the upper track and the upper guide elements (rollers) of the panels.

In the variation of FIG. 24 the upper rail 24 in configured as a vertical plate and the guide rollers 55 are mounted for vertical rotation in roller housings 53 affixed to the tops 57 of the panels.

Figure 10:
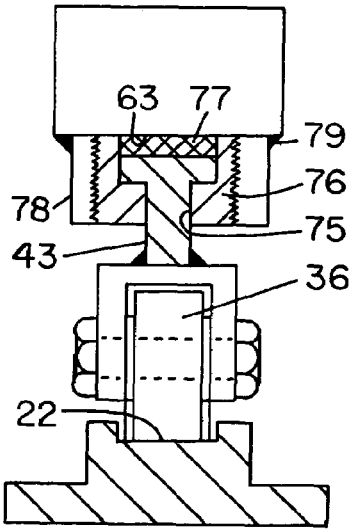
FIG. 10 is a partially cross-sectional lateral view of one type of thrust bearing mounting for the caster type rollers.

Referring to FIG. 10, a variation of the lower track roller mounting is shown where the spindle 43 is rotatably mounted through a bore 75 in a bushing 76 and bears against a thrust bearing 77. A sleeve member 78 welded at 79 to the bottom 63 of the panel threadedly receives bushing 76.

Figure 11:
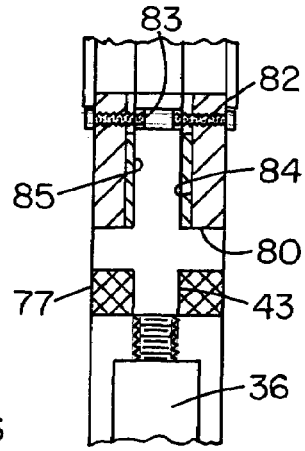
FIG. 11 is a view as in FIG. 10 showing a variation of the thrust bearing roller mounting.

In the variation of FIG. 11, the spindle 43 is provided with an annular shoulder 80 for engaging thrust bearing 77. Screws 82 threaded through the bottom 63 of the panel slidably nest in an annular groove 83 in the spindle for retaining it in bore 84 up into 63. Sleeve bearing means 85 are preferably provided for the spindles.

In FIGS. 12 and 13 a latch 65 is shown for tightly drawing the panels together edgewise after they have been properly positioned. The latch comprises at threaded shaft 67 having an eye segment 69 through which a shaft member 71 is slidably mounted and fixed to bearing members 86 welded to an edge portion of each panel. A bushing member 87 is provided with a bore 88 for slidably receiving shaft 67. A semi-sleeve member 89 is welded to an adjacent edge portion of each panel and is provided with a slot 90 for allowing pivoting of 67 around 71 and removal of bushing member 87 from 89. A thumb nut 91 is provided for tensioning 67 sufficiently to retain said panels in edgewise contact. Additional such latches placed where desired on the panels may, of course, be used.

The invention has been described in detail with particular reference to preferred embodiments thereof, but it will be understood that variations and modifications will be effected with the spirit and scope of the invention.

I claim:

1. A radiation protection shield assembly comprising a plurality of generally rectangular (includes square) panels each of which is of a designed thickness and having an inner radiation attenuating core encased (canned) in a steel (includes stainless) shell and having tracking rollers mounted on the bottom of each panel, lower track means mounted on a base for rollably supporting said rollers for movement of each said panel on said track along a tracking axis thereof to a designated position, said lower track means being longitudinally configured to allow said panels to be rolled to positions to isolate workers in a particular area from a source of harmful radiation, complementary first guide means on said lower track and on said rollers for maintaining proper contact of said rollers with said track, upper track means mounted on upper portions of a rigid support structure lying adjacent upper portions of said panels, complementary second guide means on said upper track and on said upper portions of said panels for maintaining a substantially vertical posture of said panels, said upper track means having substantially the same tracking axis as said lower track means and wherein said core comprises a plurality of vertically oriented lead sheets.

2. The shield assembly of claim 1 wherein said guide means on said upper portions of said panels comprises rollers mounted on said upper portions with the rotational axes of said rollers being parallel to a vertical plane of said panels.

3. The shield assembly of claim 1 wherein said support structure comprises connector means affixed to stationary portions of a building and to said upper track means.

4. The shield assembly of claim 3 wherein said connector means has a clamp structure adapted to be clamped onto top portions of a radiation protection wall, and a length adjustment means comprising a threaded shaft mounted in a threaded tube wherein a free end of one of said tube or shaft is mounted on said clamp structure and a free end of the other of said tube or shaft is mounted on said upper track means, and wherein one of said tube or shaft is rotatably mounted whereby rotation thereof will change the length of said adjustment means and adjust the verticality of said upper track means and panels.

5. The shield assembly of claim 4 wherein the mounting structure for said shaft and tube ends each comprises a vertically swivelable element whereby differences in the heights of said stationary portions and said upper track means will not hinder the adjustment action of said length adjustment means.

6. The shield assembly of claim 1 wherein said longitudinally spaced stabilizer arms are affixed to each side portion of said lower track means and each arm extends outwardly therefrom and terminates at a foot portion of the arm, a bracing member having a lower end affixed to each said arm adjacent the foot portion thereof and having an upper end affixed to said upper track means in a longitudinally spaced manner, the dimensions of said bracing members and their points of attachment to said arm and said upper track means providing a laterally oriented triangular geometric, free standing structure wherein said panels lie in a substantially vertical plane.

7. The shield assembly of claim 6 wherein said lower track means and said foot portions of said arms are provided with leveling means for ensuring that the vertically of said panels can be attained even on a non-level floor.

8. The shield assembly of claim 6 wherein said arms are removably affixed to said lower track means and said bracing members, and wherein said bracing members are removably affixed to said upper track means, whereby a readily assemblable shield unit can be easily transported to a site.

9. The shield assembly of claim 7 wherein said leveling means comprises bolts threadedly mounted through said lower track means and said foot portions and engageable with said floor.

10. The shield assembly of claim 1 wherein cooperating elements of latch means are provided on adjacent edge portions of adjacently positioned panels whereby said panels can be retained in proper edge to edge juxtaposition.

* * * * *